US009550308B2

(12) United States Patent
Kellermann et al.

(10) Patent No.: US 9,550,308 B2
(45) Date of Patent: Jan. 24, 2017

(54) DEVICE FOR PERFORATING AND/OR FLUTING AND/OR PUNCHING FOR ROTARY PRESSES, IN PARTICULAR FOR ROTARY PRINTING PRESSES

(75) Inventors: Oliver Kellermann, Altdorf (DE); Roberto Croci, Kammerstein (DE)

(73) Assignee: Cito-System GmbH, Schwaig bei Nuernberg (DE)

( * ) Notice: Subject to any disclaimer, the term of this patent is extended or adjusted under 35 U.S.C. 154(b) by 191 days.

(21) Appl. No.: 14/350,144

(22) PCT Filed: Oct. 7, 2011

(86) PCT No.: PCT/EP2011/005017

§ 371 (c)(1),
(2), (4) Date: Apr. 7, 2014

(87) PCT Pub. No.: WO2013/050053

PCT Pub. Date: Apr. 11, 2013

(65) Prior Publication Data

US 2015/0000494 A1 Jan. 1, 2015

(51) Int. Cl.
*B26D 9/00* (2006.01)
*B26D 7/26* (2006.01)
(Continued)

(52) U.S. Cl.
CPC . *B26D 9/00* (2013.01); *B26D 3/06* (2013.01); *B26D 7/2614* (2013.01); *B26F 1/10* (2013.01);
(Continued)

(58) Field of Classification Search
CPC ..... B26D 3/06; B26D 7/2614; B26D 9/00; B26F 1/10; B26F 1/384; B41G 7/006;B41G 7/00; Y10T 83/9408; Y10T 83/606; Y10T 83/9466; Y10T 83/9312; Y10T 83/4798; Y10T 83/5833; B41F 23/08; B41F 19/008
(Continued)

(56) References Cited

U.S. PATENT DOCUMENTS 2,566,919 A * 9/1951 Black ..... B41F 15/36 101/127.1
3,388,369 A * 6/1968 Zalmans ..... H01R 4/182 101/415.1
(Continued)

FOREIGN PATENT DOCUMENTS

DE 102006050540 A1 5/2007
EP 1068077 B1 6/2002

*Primary Examiner* — Ghassem Alie
(74) *Attorney, Agent, or Firm* — Laurence A. Greenberg; Werner H. Stemer; Ralph E. Locher

(57) ABSTRACT

A device for perforating and/or fluting and/or punching for rotary presses and/or rotary printing presses has a rotation cylinder with a holding device that fixes a base plate of a flexible and dimensionally stable material to the rotation cylinder. Fixing rods are arranged at a distance from each other in the peripheral direction of the rotation cylinder, the rods holding a flexible tool support supporting at least one machining tool on the rotation cylinder such that tool support lies directly or indirectly on the base plate. The fixing rods are respectively formed from at least one multi-jointed hinge bar having a first hinge bar which holds the hinge bar on the rotation cylinder. A second hinge bar is articulated to the first hinge bar so that, when the hinge bars are superimposed and/or closed, the tool support is clamped and/or received between the bars.

21 Claims, 7 Drawing Sheets

(51) Int. Cl.

| | |
|---|---|
| ***B26D 3/06*** | (2006.01) |
| ***B41G 7/00*** | (2006.01) |
| ***B26F 1/38*** | (2006.01) |
| ***B26F 1/10*** | (2006.01) |

(52) U.S. Cl.
CPC ..... *B26F 1/384* (2013.01); *B41G 7/006* (2013.01); *Y10T 83/9382* (2015.04); *Y10T 83/9387* (2015.04)

(58) Field of Classification Search
USPC ..... 83/698.42, 659, 678, 332, 393, 397, 83/343, 698.11, 347, 674, 331, 348, 94, 83/657, 660, 300, 302, 303, 673, 676, 83/695, 667, 669; 101/226, 136, 415.1, 101/382.1, 378, 383, 409, 218, 217, 14; 270/21.1; 493/367, 323
See application file for complete search history.

(56) References Cited

U.S. PATENT DOCUMENTS

| | | | | |
|---|---|---|---|---|
| 4,183,299 | A * | 1/1980 | Cappel | B41F 27/1243 101/415.1 |
| 5,295,436 | A * | 3/1994 | Kittsteiner | B41F 30/04 101/378 |
| 6,651,539 | B1 | 11/2003 | Eicher et al. | |
| 7,404,357 | B2 * | 7/2008 | Knabe | B41F 21/10 101/217 |
| 7,581,494 | B2 | 9/2009 | Hochmueller et al. | |

* cited by examiner

FIG. 6 B-B
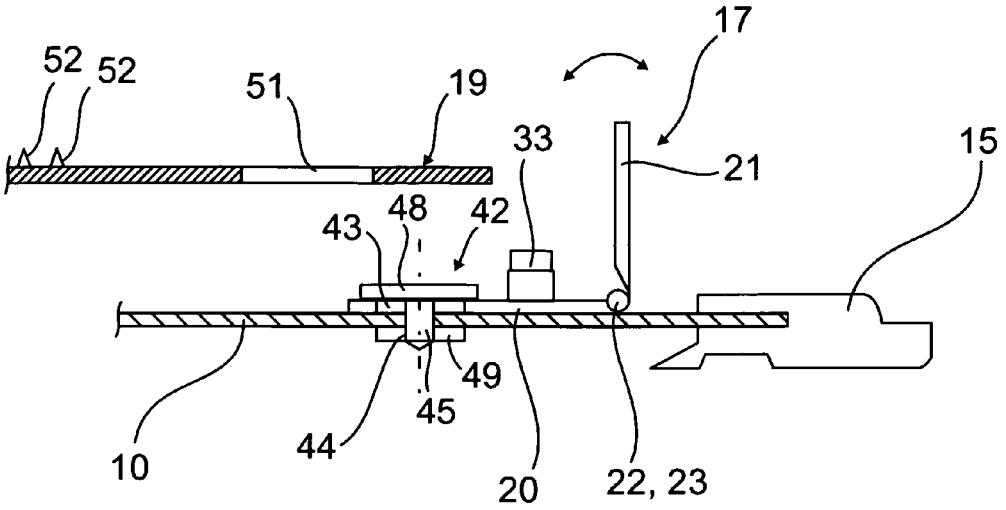
FIG. 7
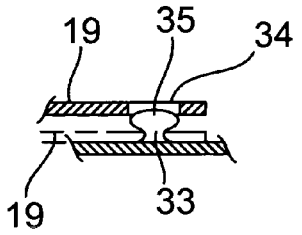
FIG. 8
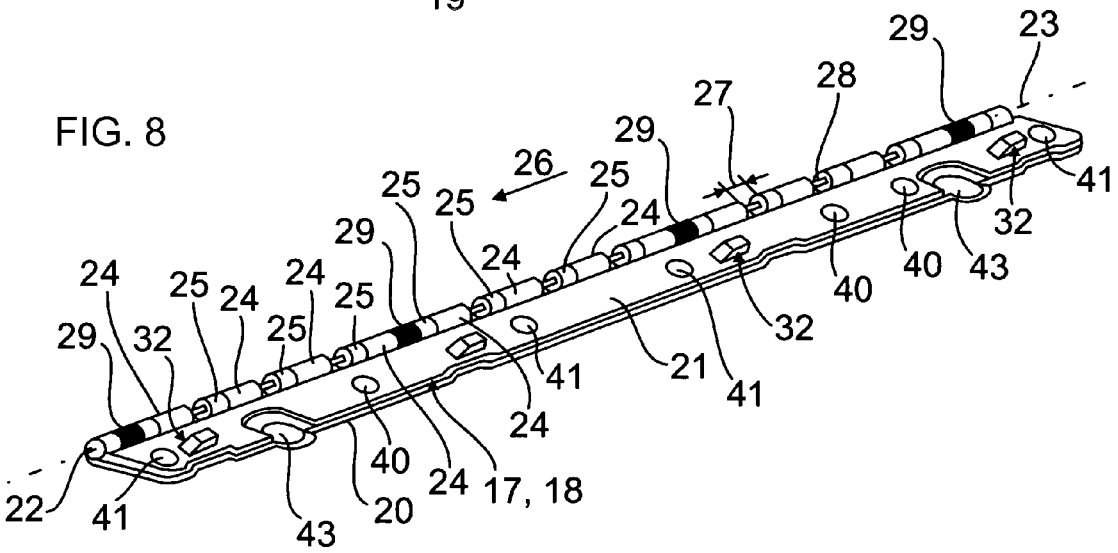

DEVICE FOR PERFORATING AND/OR FLUTING AND/OR PUNCHING FOR ROTARY PRESSES, IN PARTICULAR FOR ROTARY PRINTING PRESSES

BACKGROUND OF THE INVENTION

Field of the Invention

The invention relates to a device for perforating and/or fluting and/or punching for rotary presses, in particular for rotary printing presses with a rotary cylinder with a holding device, by means of which a base plate which is made from a flexible and dimensionally stable material is fastened on the rotary cylinder, fastening bars which are spaced apart in the circumferential direction of the rotary cylinder additionally being provided, by means of which a flexible tool plate which carries at least one processing tool is held on the rotary cylinder in such a way that said flexible tool plate rests indirectly or directly on the base plate.

A device of the generic type for perforating, fluting or punching for rotary printing presses is known from EP 1 068 077 B1. Said device has at least one printing and/or varnishing unit which has a rubber blanket cylinder with a blanket holding device, formed by two tensioning shafts, for a rubber blanket and an impression cylinder which is assigned to the rubber blanket cylinder. Furthermore, the rubber blanket cylinder has a cylinder channel, in which the tensioning shafts are received. Instead of the rubber blanket, a base plate made from a flexible and dimensionally stable material is fastened to the rubber blanket cylinder, on which base plate a thin base sheet lies in a flat bearing connection in the tensioned state. Elevated processing profiles as perforating and/or fluting and/or punching profiles, corresponding in a predefinable manner to perforating and/or fluting and/or punching dies, can be applied, in particular adhesively bonded, to the base sheet.

In order to fasten or fix the base sheet, the base plate has holding rails on the end regions which lie opposite one another in the circumferential direction of an associated rubber blanket cylinder, which holding rails correspond to the holding rails of a rubber blanket, with the result that the base plate can be secured on the rubber blanket cylinder by means of the tensioning shafts in an analogous manner to the rubber blanket. Furthermore, spaced apart from said end-side holding rails which are assigned to the tensioning shafts, fastening bars which are likewise spaced apart in the circumferential direction of the associated rubber blanket cylinder are attached to the base plate, to which fastening bars the base sheet can be fastened releasably in the tensioned state by way of edge regions which lie opposite one another. As a result of this releasable fastening of the base sheet on the base plate which is attached on the rubber blanket cylinder in a positionally fixed manner, relative positional corrections between the base plate and the base sheet and therefore also positional corrections with respect to a sheet to be processed can be carried out, without changing the dies which are applied to the base sheet. Since the fastening bars can be displaced and can also be fixed again with respect to the base plate within setting ranges, positional corrections of the base sheet with the processing profiles which have already been adhesively bonded in a dimensionally accurate manner can be carried out rapidly and simply with respect to the base plate.

The fastening bars for the base sheet are therefore arranged in an elevated manner on the outer circumferential face of the rubber blanket cylinder which is set up in this way, and are freely accessible. By way of a system of this type, perforating and/or fluting and/or punching dies can be applied to the base sheet in a simple and comfortable manner outside the machine, it being possible for the base sheet itself to be fixed simply to the base plate by means of the fastening bars. The base sheet with applied perforating, fluting or punching dies can therefore be replaced quickly and simply, it being possible for base sheets which have been constructed once to be archived and thus to be reusable for, for example, periodicals without renewed setting-up outlay.

Furthermore, WO 2008/055516 A1 discloses a similar basic construction, in which, however, in contrast to EP 1 068 077 B1, the base sheet is not fixed on the base plate by means of fastening bars, but rather is likewise fixed on the holding device, formed by tensioning shafts, for the rubber blanket.

BRIEF SUMMARY OF THE INVENTION

In contrast, it is an object of the present invention to develop a device for perforating and/or fluting and/or punching for rotary presses or rotary printing presses in such a way that the functionality and operating capability of said device is improved and/or simplified further.

This object is achieved by way of the features as claimed. Advantageous embodiments in this respect are the subject matter of the dependent claims.

In accordance with the invention, a device for perforating and/or fluting and/or punching for rotary presses, in particular for rotary printing presses, is proposed, which device has a rotary cylinder, in particular a rubber blanket cylinder or a varnishing rubber blanket cylinder or the like, with a holding device, by means of which a base plate made from a flexible and dimensionally stable material, preferably a rectangular and/or surface-stable plastic plate, is fastened on the rotary cylinder (for example, instead of a rubber blanket in the case of the rubber blanket cylinder), fastening bars which are spaced apart in the circumferential direction of the rotary cylinder additionally being provided, by means of which a flexible tool plate (for example, a base sheet or a punching plate) which carries at least one processing tool can be held on the rotary cylinder in such a way that said flexible tool plate rests indirectly or directly on the base plate, in particular rests in a flat and tensioned manner. It is provided according to the invention that the fastening bars are formed in each case by at least one multiple-limb hinge bar which has a first hinge limb, by means of which the hinge bar is held on the rotary cylinder, in particular on the holding device and/or on the base plate. Furthermore, a second hinge limb is provided which is connected to the first hinge limb in an articulated manner via a hinge axis in such a way that, in the state of the hinge limbs in which they are folded onto one another and/or together, the tool plate is clamped and/or received between said hinge limbs, preferably by way of an edge region of said tool plate.

By way of a hinge bar of this type which receives or clamps the tool plate between itself on the edge region side, a fastening bar which is less intensive in terms of components and is therefore compact and simple to handle is provided in a simple way, by means of which fastening bar the tool plate can additionally be arranged and fixed positionally in the desired position in a functionally reliable manner. The clamping of the tool plate in the hinge bars is therefore simplified substantially, as a result of which a considerable time saving can be achieved during setting up of a printing press. Furthermore, the hinged joint connection between the two hinge limbs ensures that the hinge limbs are situated in the desired relative position with respect to one another in every pivoting position. Here, depending on the specific embodiment of the hinge bar, for example, the first hinge limb can in principle also be an integral constituent part of the base plate or of the holding device, that is to say can be formed by the latter itself, and the second hinge limb can then accordingly be articulated on the base plate side or holding device side, although the multiple limb embodiment of the hinge bar is preferred, which multiple limb embodiment can be fixed on the base plate or the holding device, since a hinge component of this type is simpler to handle and can be used more flexibly, in particular in conjunction with a preferably provided displacement option of the hinge bar relative to the base plate or relative to the holding device, which will be described in greater detail in the following text.

Here, a flexible and dimensionally stable base plate is understood to mean a base plate made from a material such that it has a hard, substantially unchangeable surface, in order to form a corresponding support for the pressure-loaded tools. Said plate, for example a plastic plate made from a corresponding hard plastic, is to be of flexible configuration at least in the cylinder circumferential direction, however, such that it can be clamped onto a rotary cylinder, for example, instead of a rubber blanket or a varnishing blanket or the like.

Furthermore, it goes without saying that the clamping of the base plate on the rotary cylinder or the tensioning of the tool plate on the base plate or on the rotary cylinder has to take place in such a way that they are in each case tensioned in the circumferential direction and, in particular, the tool plate lies in a flat bearing connection on the base plate at least in the printing surface region of the rotary cylinder.

Furthermore, a hinge bar of this type makes particularly simple fixing of the two hinge limbs possible in the state in which they are folded onto one another or together, by it being possible for said hinge limbs to be latched or clipped to one another releasably by means of a latching connection which can also be called a clipped connection, for example in accordance with one preferred embodiment as claimed. A latching connection of this type can be produced simply and with high functional reliability, for example by way of simple folding together or pressing together of the hinge limbs, and can additionally also be released again simply.

In this context, an embodiment of the invention is particularly advantageous, in which it is provided that at least one force accumulator, in particular at least one spring element, is provided which prestresses the hinge limbs in the direction of the latching engagement in the folded-together state, it being possible for the second hinge limb to be displaced counter to the force of the at least one force accumulator, in order to bring said second hinge limb into and/or out of latching engagement with the first hinge limb. By means of a force accumulator of this type which is preferably formed by at least one spring element, a very functionally reliable latching connection can therefore be produced in a particularly simple and inexpensive way, since the at least one force accumulator ensures that the hinge limbs are prestressed in the direction of latching engagement in the folded-together state. The release of said latching engagement is therefore possible only if a counterforce is applied counter to the force of said force accumulator, in order, for example, to fold open the hinge limbs in order to replace the tool plate. Overall, a means which is very simple to handle, is inexpensive and at the same time is functionally reliable is therefore provided here, in order to hold the hinge limbs in the folded-together state.

A further essential advantage of the force accumulator or spring loading is that, as a result, a substantially rattle-free construction is obtained, even during operation, which construction contributes substantially to ensuring high quality of the perforating, fluting and/or punching work.

For a particularly compact and integrated-component solution with a high functional reliability, it is proposed in this context that the at least one force accumulator is integrated into the hinged joint connection between the hinge limbs, which hinged joint connection forms the hinge axis, for example into corresponding hinge axis free regions which are on the hinge axis side and release a displacement travel.

For a particularly compact construction which can be produced simply, it is proposed that joint parts which are in each case spaced apart from one another and engage at least in regions around a hinge rod which forms the hinge axis are formed on the hinge limbs. The joint parts of the hinge limbs which are connected pivotably to one another are preferably offset here with respect to one another in such a way that they in each case engage around different hinge rod part regions and/or in each case one joint part of the first hinge limb follows a joint part of the second hinge limb. In relation to the latched and folded-together state of the hinge limbs, the joint parts are arranged as viewed in the hinge axis longitudinal direction in such a way that in each case a hinge rod-side free region which defines or releases a displacement travel and is not engaged around by any of the joint parts is formed between the joint parts of the second hinge limb and a joint part of the first hinge limb, which joint part lies in front in the displacement direction of the second hinge limb. A force accumulator, in particular a spring element, can then be arranged at least in one of said free regions, which force accumulator prestresses the respectively associated joint part of the second hinge limb in the direction away from that joint part of the first hinge limb which lies in front in the displacement direction, and therefore counter to the displacement direction, in particular prestresses it in the direction of that joint part of the first hinge limb which lies behind. A construction of this type, as has already been explained, can be produced in a structurally simple way and makes simply handleable force accumulator-dependent displacement of the second hinge limb relative to the first hinge limb possible.

In this specific case, one embodiment is particularly preferred, in which the free regions have a substantially identical length in the hinge axis longitudinal direction. This ensures a displacement travel which is always identical overall between the individual associated joint parts, as a result of which blocking of the displacement is avoided reliably. At the same time, high operating security for the user is made available as a result.

For a construction of the latching connection which is particularly functionally reliable and can be handled simply, it is proposed that said latching connection has at least one latching hook which protrudes from the first hinge limb and, in the latched state, is engaged behind preferably in a positively locking manner by an edge region of a latching recess of the second hinge limb. A specific embodiment of the invention is particularly preferred here, in accordance with which it is provided that the at least one latching hook or at least one latching hook has a ramp-shaped oblique surface region which is assigned to the edge region of the latching recess and along which the edge region of the latching recess, during its transfer into the latching engagement, slides in a guided manner such that at the same time the second hinge limb is displaced relative to the first hinge limb in the hinge axis longitudinal direction counter to the force of the at least one force accumulator, the edge region of the latching recess snapping under the latching hook and engaging behind the latter preferably in a positively locking manner at the end of the ramp-shaped oblique surface region in a manner which is loaded by the force of the at least one force accumulator. Reliable and, above all, also adapted purchase of the hinge limbs can therefore be achieved in the state in which they are folded onto one another or together by means of a specific latching connection of this type, which is also essential for the operational reliability of the rotary press, for example a printing press in conjunction with a device of this type.

Secondly, as has already been described, a rear grip latching connection of this type can also be released again simply by way of loading of the force accumulator in a manner which is directed in the opposite direction. Overall, increased operational reliability and operating security is achieved as a result.

In conjunction with the above-described specific embodiment, a construction is advantageous, in particular, in which, in accordance with the invention, as viewed in the hinge axis longitudinal direction, a plurality of latching hooks which are spaced apart from one another are arranged on the first hinge limb, and/or that, as viewed in the hinge axis longitudinal direction, the at least one latching hook is oriented in such a way that the latching hook-side rear grip region, into which the edge region of the latching recess engages, lies in the hinge axis longitudinal direction. A specific arrangement or orientation of this type of the latching hooks ensures that the operator can release the latching engagement simply, it also being ensured at the same time that the force accumulator presses the second hinge limb in a reliable rear grip by way of the latching hook of the first hinge limb and, above all, also holds said second hinge limb there.

It goes without saying that, in principle, embodiments are also of course possible, in which, for example, the latching hook is formed on the second hinge limb and the latching recess is formed on the second hinge limb in an equivalent way. This is expressly to be included in the scope of protection although, in particular with regard to reliable receiving and/or clamping of the tool plate between the hinge limbs, the arrangement of the elevated latching hook elements on the first hinge limb is advantageous, since its elevated nature which possibly impairs the clamping action can be counteracted by way of simple recesses in the region of the second hinge limb. Correspondingly, it is proposed in accordance with one preferred embodiment as claimed that, in the folded-together state of the hinge limbs, said hinge limbs bear against one another substantially in a flat bearing connection even without the tool plate and/or bear against the tool plate in a flat bearing connection with clamping of said tool plate, it preferably being provided that the second hinge limb has a cutout and/or a recess in the region of elements and/or components which protrude from the first hinge limb.

According to one particularly preferred specific embodiment, it is proposed in accordance with the invention that the tool plate is held on the rotary cylinder, in particular on the holding device and/or on the base plate and/or on at least one hinge bar, in a manner which is releasable and/or displaceable within predefined setting ranges relative to the rotary cylinder, in particular relative to the holding device and/or relative to the base plate and/or relative to at least one hinge bar, and such that it can be fixed positionally again after a displacement. By way of an embodiment of this type, a simple positional correction option with regard to the at least one tool plate-side tool is made available directly on the rotary cylinder, that is to say in an inline manner, without it being necessary for the tool plate to be removed from the rotary or printing press for this purpose.

This relative displacement option of the tool plate or the tool plate-side tools within predefined or defined setting ranges can be achieved in accordance with a first preferred alternative, for example, by way of a relative displacement of at least one hinge bar relative to the rotary cylinder, in particular relative to the holding device and/or relative to the base plate, it then being possible in this case for the tool plate to be connected to the hinge bar or hinge bars, for example, in a fixed and non-displaceable, that is to say positionally fixed, manner, for example via register recesses. As an alternative to this, the relative displacement option of the tool plate or the tool plate-side tools within predefined or defined setting ranges can also be achieved in an equivalent way, however, by way of a relative displacement of the tool plate relative to at least one of the hinge bars, it then being possible in this case, for example, for the hinge bars to be connected in a fixed and non-displaceable manner to the rotary cylinder, in particular to the holding device and/or to the base plate. It goes without saying that a combination of both options is also possible in principle, that is to say that the relative displacement option of the tool plate or the tool plate-side tools within predefined or defined setting ranges is made available both by way of a relative displacement of at least one hinge bar relative to the rotary cylinder, in particular relative to the holding device and/or relative to the base plate, and by way of a relative displacement of the tool plate relative to at least one of the hinge bars, with the result that the operator can select whether he/she uses one or the other or both displacement options for positional correction. Specific embodiments in this respect will be explained in greater detail in the following text:

For the simple and functionally reliable production of the displaceability of the hinge bars in defined or predefined setting ranges, it is proposed in accordance with the invention that the first hinge limb is fixed by means of at least one clamping and oversize connection on the base plate and/or on the rubber blanket holding device for an arrangement of the tool plate on the holding device and/or on the base plate such that it can be displaced in predefined setting ranges and can subsequently be fixed again, which clamping and oversize connection has a holding device-side or base plate-side threaded recess for a threaded shank of a clamping bolt which is preferably formed by a clamping screw or a tensioning bolt or a clamping means of the like, and which threaded recess is assigned a recess of the first hinge limb, which recess has a defined oversize with respect to said threaded recess and, in the case of an open clamping bolt, permits a relative displacement of the hinge limb recess relative to the threaded recess and/or relative to the threaded shank, received therein (in so far as said threaded shank is still received therein), of the clamping bolt.

In the case of a tightened clamping bolt, in contrast, a clamping bolt head part, for example a screw head of a clamping screw or a tensioning head of a tensioning bolt, which has an oversize with respect to the hinge limb recess clamps the first hinge limb fixedly, with the result that the latter is therefore positionally fixed. A clamping and oversize connection of this type can be handled in a simple and functionally reliable manner and therefore makes the release of the displacement in all spatial directions on the base plate plane or the holding device plane possible, with the result that the hinge bars on their own or else the hinge bars together with clamped-in tool plate can be displaced in a functionally reliable way into the desired position and can be positionally fixed accordingly, to be precise on or inside the press, with the result that unclamping and removal of the device from the printing press or from the rotary cylinder is not required.

According to one preferred specific embodiment, it is provided in this regard that a plurality of locating pins which are spaced apart from one another as viewed in the hinge axis longitudinal direction are arranged on the first hinge limb, on which locating pins the tool plate can be hooked in a releasable and/or positively locking manner by way of associated register recesses. In this way, particularly functionally reliable positioning and, above all, also exact positioning of the tool plate on the hinge bars are possible.

In this context, a locating pin embodiment is advantageous in accordance with the invention, which locating pin embodiment has an end region which widens in the manner of a spherical head and onto which the tool plate can then be buttoned in such a way that its register recesses engage behind the end region which is formed in this way in the buttoned state. As a result, in particular, simple and functionally reliable fixing of the tool plate on the hinge bars is made possible, since a construction of this type ensures that the tool plate cannot detach automatically from the locating pins. This substantially increases the operating security and user-friendliness of the device overall.

As an alternative to this, it can be provided with substantially the same advantages that, on its edge regions which lie opposite one another in the cylinder circumferential direction, the tool plate has register recesses which have an oversize with respect to the locating pins of the hinge bar which are assigned to the register recesses, in particular the locating pins of the first hinge limb which are assigned to the register recesses, with the result that, in the case of an open hinge bar, the tool plate can be displaced within predefined setting ranges relative to the hinge bar and therefore relative to the rotary cylinder or relative to the base plate and/or relative to the holding device, and is clamped again in a positionally fixed manner between the hinge limbs after a displacement. In this context, it can be provided in accordance with claim 16, for example, that the hinge bar is held fixedly and non-displaceably on the rotary cylinder, in particular on the holding device and/or on the base plate; here, the first hinge limb could then possibly also be formed, as described at the outset, in principle by the base plate or the holding device itself.

For the combined solution which corresponds to alternative c) noted above, the subjects of several claims can then be combined with one another correspondingly, for example.

In accordance with the invention, the tool plate can be formed by a base sheet, preferably made from a plastic material, on which elevated processing profiles can be applied, in particular adhesively bonded, which base sheet has register recesses on edge regions which lie opposite one another in the circumferential direction of the rotary cylinder, which register recesses are assigned to hinge bar-side locating pins. A base sheet of this type can be formed, for example, by a thin plastic film, for example in the order of magnitude of from approximately 0.15 to 0.20 mm.

According to a particularly preferred alternative embodiment to this, in accordance with the invention, however, the tool plate can also be formed by a punching plate which has at least one processing profile and, on edge regions which lie opposite one another in the circumferential direction of the rotary cylinder, has register recesses which are assigned to hinge bar-side locating pins. By way of a solution of this type, a punching plate is therefore provided for the first time which can be archived and, for positional correction, is secured there such that it can be displaced relative to the base plate and/or to the holding device and/or to the hinge bar.

Even if, in the above text, the plural is always used in conjunction with the register recesses and the associated locating pins, because this represents the preferred embodiment, it goes without saying that, in principle, only a single register recess could also be provided with a single associated locating pin.

It is proposed according to a further particularly preferred embodiment that the hinge bars are arranged on the base plate in such a way that, in the state in which it is clamped onto the rotary cylinder, they lie in a cylinder recess of the rotary cylinder, which cylinder recess receives the holding device. As a result, firstly the operating reliability is increased and at the same time, as viewed in the circumferential direction of the rotary cylinder, more space is also available, however, on which processing profiles or tools can be applied or can be present. This ensures in a simple way that no elevated components are situated in the region outside the cylinder circumference or any possible cylinder channel cover (apart from the processing profiles) and, as a result, damage of other, adjacent cylinders, such as of the plate cylinder, for example, can advantageously be ruled out. Since, even if it is of relatively thin-walled configuration, the punching plate is under a relatively high stress in the clamping region on the hinge bars in this case, however, and attempts to spring away from the hinge bar-side locating pins or from the base plate, the punching plate has to be pressed downward firmly with a hand by the machine operator during clamping (a second machine operator is possibly even necessary), in order to ensure correct clamping in the hinge bars which are arranged on the base plate side. In this case, an undesirably high force acts on the hinge bar-side latching connection which is therefore to be dimensioned correspondingly, or an undesired gap is possibly even formed between the punching plate and the base plate in the region of the cylinder channel edges of the rotary cylinder which define a printing start and a printing end of the printing surface region, which gap can influence the work result disadvantageously. For this reason in particular, but not exclusively for this reason, it is proposed according to a further particularly preferred embodiment that, on the edge regions which lie opposite one another in the cylinder circumferential direction, the punching plate and optionally also the base plate in each case have an angled-over edge which runs at least partially and/or at least in sections parallel to the cylinder axis, which angled-over edge is assigned in each case to precisely one cylinder channel edge of the rotary cylinder, which cylinder channel edge defines a printing start and a printing end of the printing surface region. This ensures in a simple way that the punching plate lies on the base plate in a flat bearing connection without a gap in the printing surface region. In addition, the punching plate can be hooked without prestress on the associated hinge bar-side locating pins, with the result that it lies flatly there and the machine operator has both hands free to carry out further changeover work.

In the following text, the invention will be explained in greater detail using a drawing, in which:

DETAILED DESCRIPTION OF THE INVENTION

Figure 1:
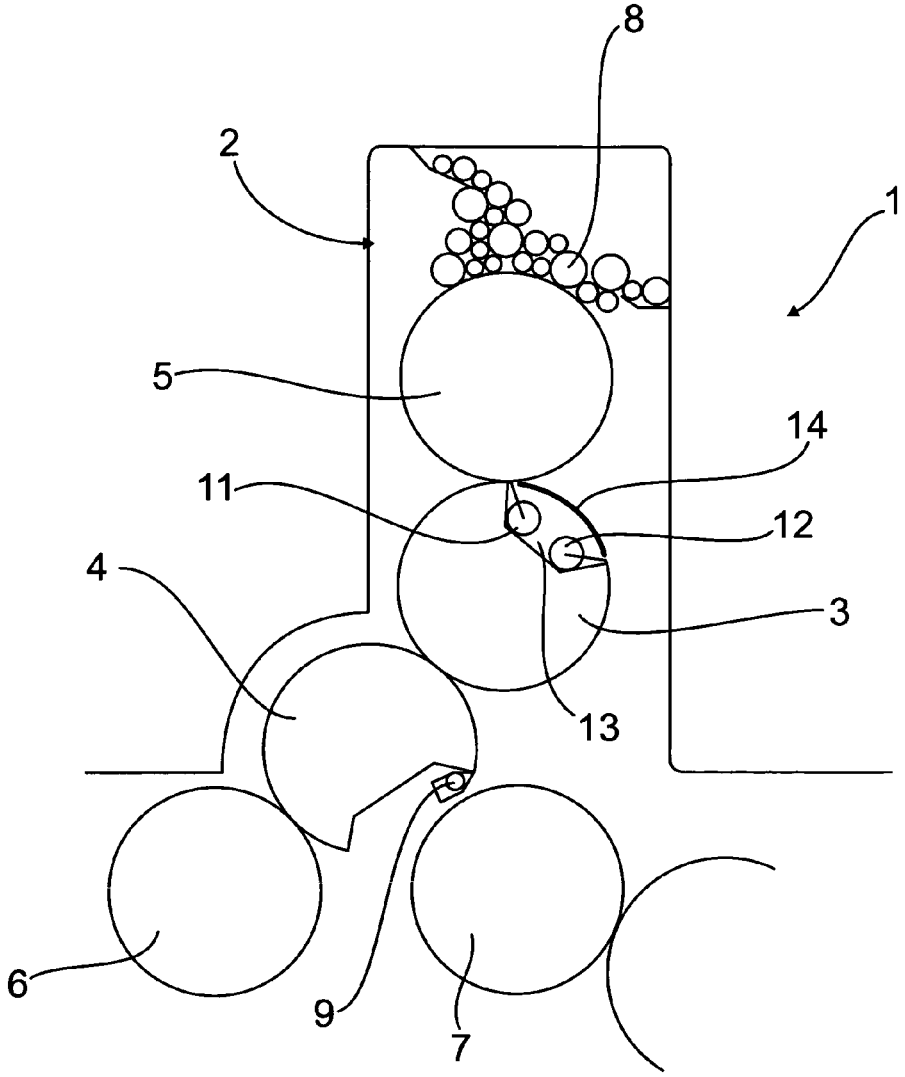
FIG. 1 shows a diagrammatic view of a printing and varnishing unit of a multiple-color rotary printing press.

FIG. 1 diagrammatically shows, by way of example, a conventional printing and varnishing unit 2 of a multiple-color sheet-fed rotary printing press 1 which has a plurality of printing and varnishing units. Said printing and varnishing unit 2 has a plate cylinder 5, via which ink 8 is applied to a rubber blanket (not shown in detail here) of a rubber blanket cylinder 3 in accordance with an inking pass of a printing image. The rubber blanket cylinder 3 has a cylinder channel 13 as a recess on the cylinder circumference side, in which cylinder channel 13 tensioning shafts 11, 12 are received as holding devices for the rubber blanket. In order to avoid accessibility, the cylinder channel 13 can be covered by way of a cylinder channel covering 14 which is fastened releasably to the rubber blanket cylinder 3. Via the rubber blanket cylinder 3, the printing image is applied to a printing sheet which is tensioned over an impression cylinder 4 and is likewise not shown here. Said printing sheet is transported to the printing and varnishing unit 2 via a sheet transport cylinder 7 into the region of the impression cylinder 4 and is gripped by a paper gripper 9 which is arranged on the impression cylinder 4. As a result, the sheet is driven in a bearing connection and is printed during the further course of the rotation of the impression cylinder 4. After the printing of the sheet, the paper gripper 9 releases the sheet again, with the result that it can be transported away by the transport cylinder 6.

A printing and varnishing unit 2 of this type can be configured for perforating, fluting and/or punching a sheet by way of a device according to the invention for perforating, fluting and/or punching. To this end, instead of the conventional rubber blanket, a rectangular flexible and surface-stable plastic plate is clamped as base plate 10 (shown here in a dotted manner) onto the rubber blanket cylinder 3 of the printing and varnishing unit 2, as is shown diagrammatically and by way of example in FIG. 2. As is shown here merely very diagrammatically, said base plate 10 has holding rails 15, 16 on the edge regions which lie opposite one another in the circumferential direction of the associated rubber blanket cylinder 3, which holding rails 15, 16 correspond to those of the rubber blankets for the respective printing press type. As a result, the base plate 10 can be clamped on the rubber blanket cylinder 3 in a manner which is as rapid and simple as a rubber blanket, by means of the tensioning shafts 11, 12 which are arranged on the rubber blanket cylinder 3.

Figure 2:
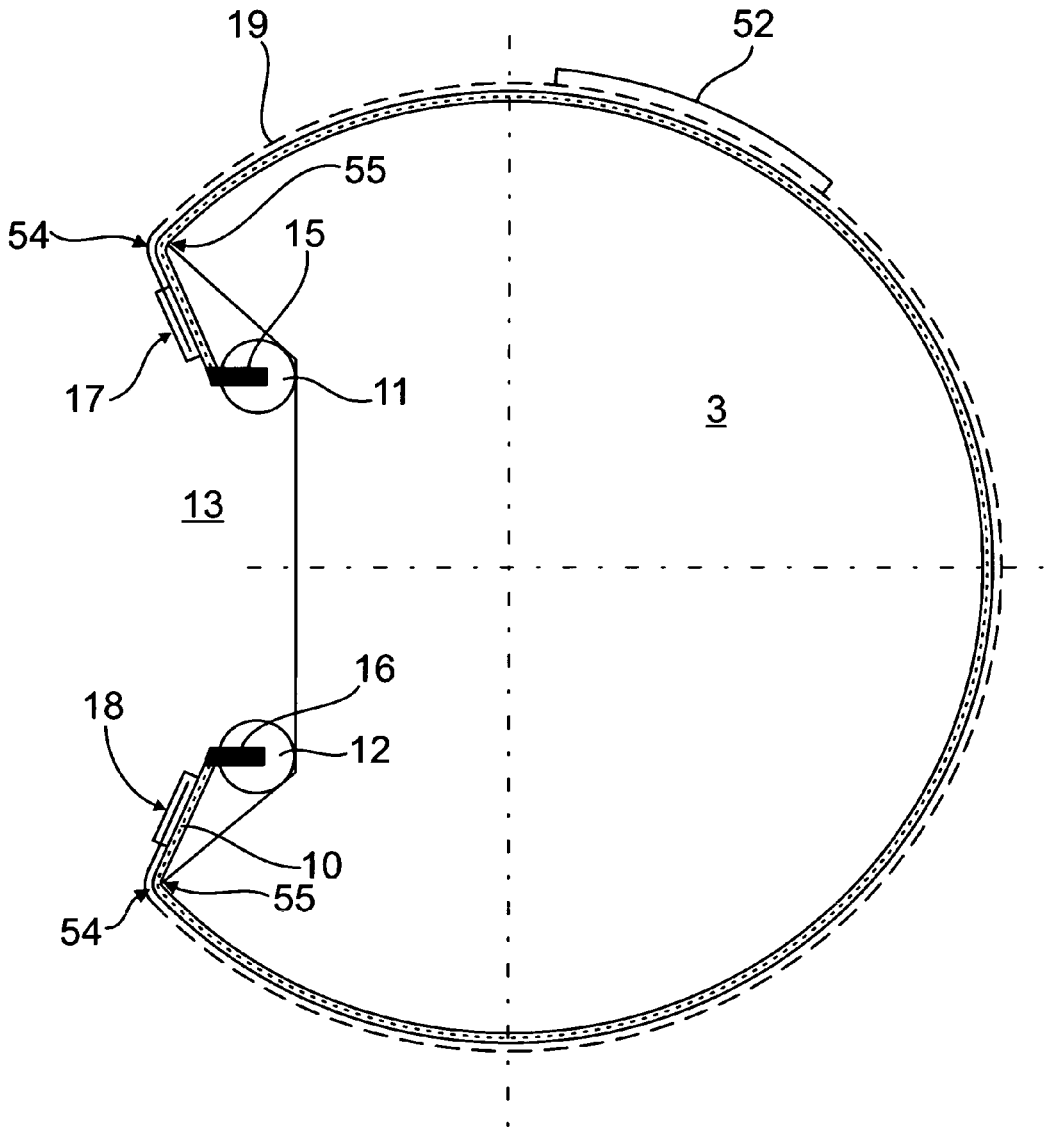
FIG. 2 shows a diagrammatic enlarged view of a rubber blanket cylinder having a hinge bar arrangement according to the invention, FIG. 3 diagrammatically shows a plan view of a base plate including hinge bars which are arranged thereon, FIG. 4 diagrammatically shows a view along the line A-A from FIG. 3, FIG. 5 diagrammatically shows a view corresponding to FIG. 4 with a folded-down second hinge limb, FIG. 6 diagrammatically shows a sectional view along the line B-B from FIG. 3, FIG. 7 diagrammatically shows an outline illustration of a locating pin, configured in the manner of a spherical head, of a first hinge limb, FIG. 8 diagrammatically and perspectively shows a hinge bar according to the invention on its own in the folded-together state.

As shown further in FIG. 2, the tensioning shafts 11, 12 are received in the cylinder channel 13 of the rubber blanket cylinder 3, which cylinder channel 13 extends substantially over the entire axial or longitudinal extent direction of the rubber blanket cylinder 3. Said cylinder channel 13 is preferably (as shown in FIG. 1) covered with a cylinder channel covering 14. However, said cylinder channel covering 14 can equally well be omitted, as is shown merely by way of example in FIG. 2.

Figure 3:
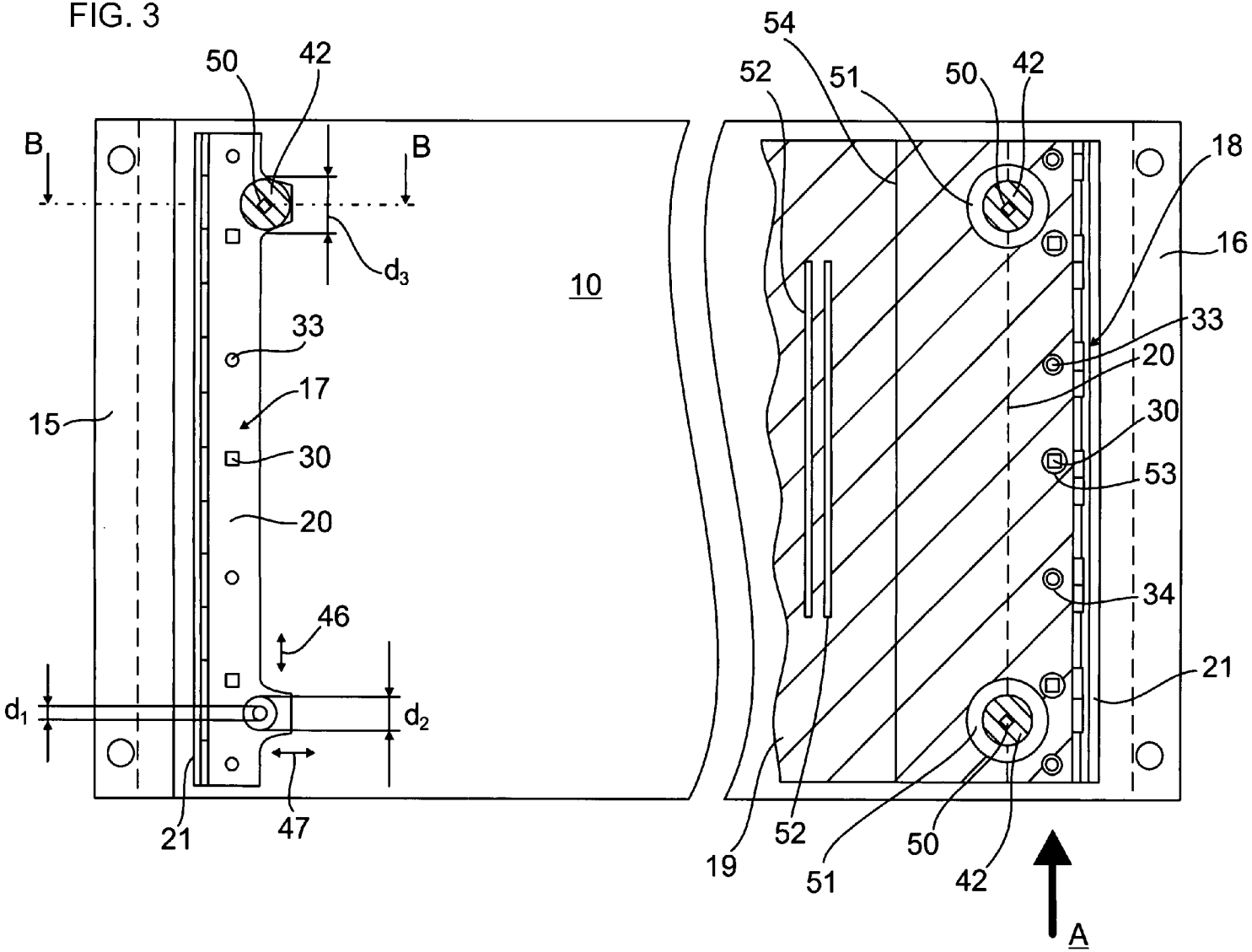
Figure 4A:
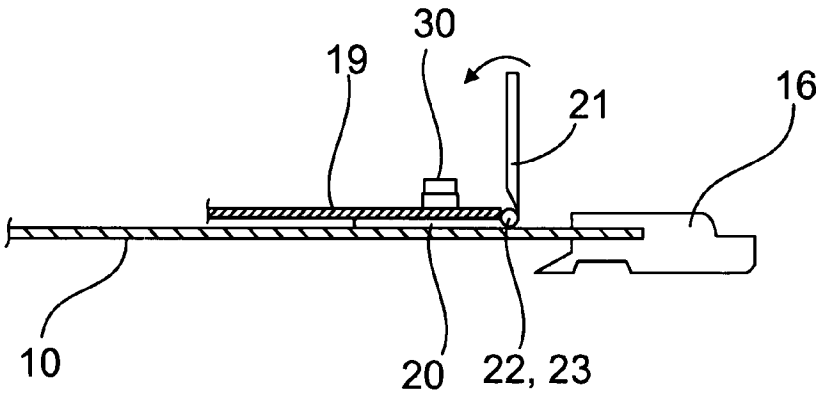
Figure 5:
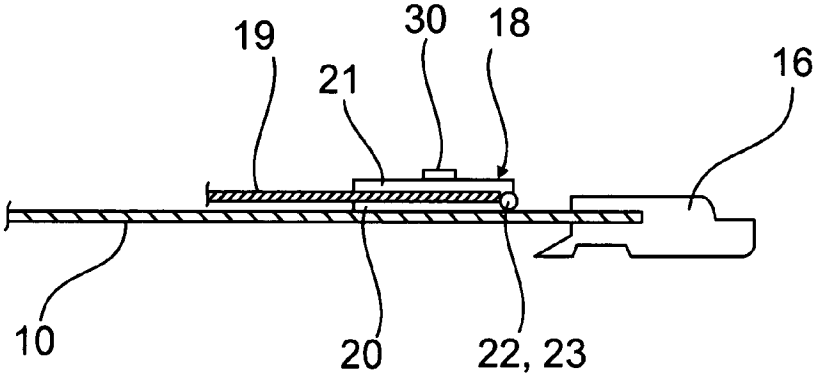

As can be seen further, in particular, from FIG. 3, fastening bars in the form of hinge bars 17, 18 for, for example, a punching plate 19 are arranged, furthermore, on the edge regions which lie opposite one another in the circumferential direction of the rubber blanket cylinder 3. As an alternative to a punching plate 19, a base sheet can also be used, as is described, for example, in EP 1 068 077 B1.

It is to be mentioned expressly at this point that, although the exemplary embodiment is described in the present case in conjunction with a rubber blanket cylinder, it goes without saying that all solutions, in which the device according to the invention can be used and which do not have a rubber blanket cylinder as cylinder, are to be considered to be equivalent solutions. To this extent, the term rubber blanket cylinder is expressly to be understood here in a very broad sense and is merely to serve for improved distinguishability and summary of the invention.

Furthermore, as can be seen, in particular, from the combination of FIGS. 3, 4, 5, 6, 8, 9 and FIGS. 11*a* to 11*c*, each of the two hinge bars 17, 18 has a first hinge limb 20 and a second hinge limb 21, the hinge bars 17, 18 being held on the base plate 10 via the first hinge limb 20 in each case in a way which is still to be described, such that they can be displaced within predefined setting ranges and in a positionally fixed manner again after a displacement. In contrast, the second hinge limb 21 is connected in an articulated manner to the first hinge limb 20 via a hinge axis 23 which is defined by a hinge rod 22. In specific terms, first joint parts 24 which are spaced apart from one another in each case as viewed in the hinge axis longitudinal direction are formed on the first hinge limb for this purpose. Furthermore, second joint parts 25 which are in each case spaced apart from one another are formed on the second hinge limb 21, both the first joint parts 24 and the second joint parts 25 in each case engaging at least in regions around a part region of the hinge rod 22.

Here, the joint parts 24, 25 of the hinge limbs 20, 21 which are connected to one another pivotably are additionally offset with respect to one another in such a way that in each case one first joint part 24 follows a second joint part 25. In relation to the folded-together state of the hinge limbs 20, 21 which is shown, for example, in FIG. 8 and in FIG. 11*c*, the joint parts 24, 25 are arranged in the hinge axis longitudinal direction in such a way that a hinge rod-side free region 28 which defines a displacement travel 27 and is not engaged around by any of the joint parts is formed between the second joint parts 25 and a first joint part 24 which lies in front in the displacement direction 26 of the second hinge limb 21.

In here by way of example a plurality of said free regions 28, a spring element 29 is arranged as force accumulator on the hinge rod 22, which spring element 29 prestresses the respectively associated second joint part 25 in the direction away from the first joint part 24 which lies in front in the displacement direction and therefore prestresses it in the direction of the respective first joint part 24 which lies behind counter to the displacement direction 26.

Furthermore, as can be seen, in particular, from the combination of FIGS. 8, 9 and 11*a* to 11*c*, a plurality of latching hooks 30 which are spaced apart from one another in the hinge axis longitudinal direction and are assigned in each case one window-shaped latching recess 31 on the second hinge limb 21 protrude from the first hinge limb 20. The latching hooks 30 including associated latching recesses 31 are a constituent part of a latching connection 32, by means of which, in the folded-together state (FIG. 8, FIG. 11*c*), the second hinge limb 21 is latched releasably to the first hinge limb 20.

Furthermore, locating pins 33 are arranged spaced apart from one another in the hinge axis longitudinal direction on the first hinge limb 20, which locating pins 33 are assigned register recesses 34 on edge regions of the punching plate 19 which lie opposite one another as viewed in the circumferential direction of the rubber blanket cylinder 3, by means of which register recesses 34 the punching plate 19 can be hooked onto the first hinge limb 20. Here, as shown in FIG. 7, the locating pins 33 are preferably configured with an end region 35 which is widened in the manner of a spherical head and onto which the punching plate 19 can be buttoned by way of the respectively associated register recess 34 in such a way that the register recesses 34 engage behind the end region which is formed in this way in a substantially positively locking manner, which is shown merely diagrammatically using dashed lines in the illustration of FIG. 7. As an alternative to this, the register recesses 34 can also have an oversize with respect to the locating pins 33 and, in the folded-together state of the hinge bars 17, 18, can be clamped fixedly between the two hinge limbs 20, 21, that is to say can be held with a corresponding clamping force.

Figure 9:
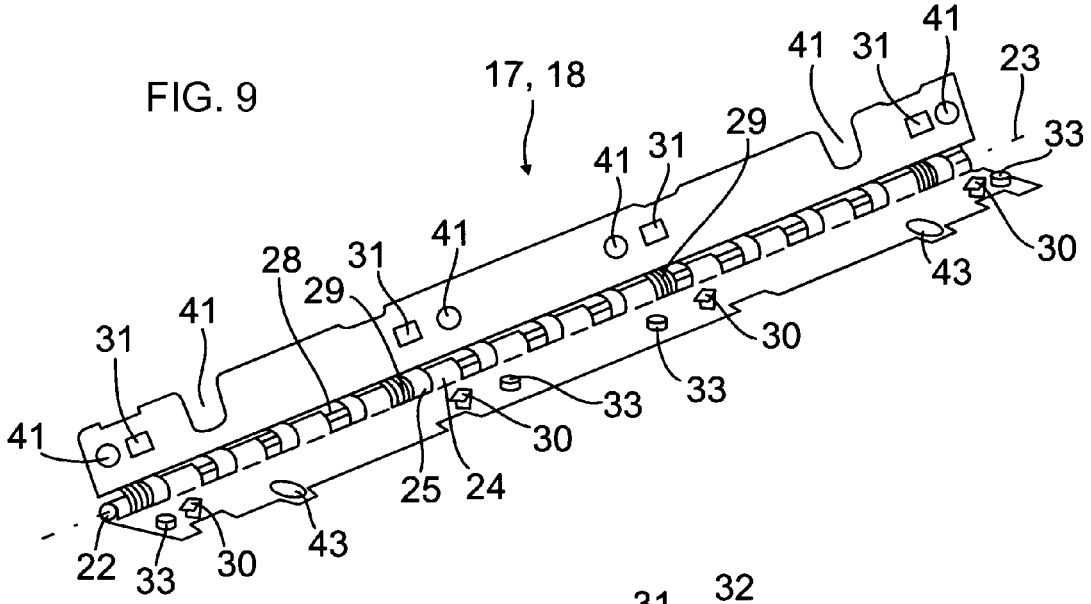
FIG. 9 shows the hinge bar according to FIG. 8 in the folded-open state of the hinge limbs.
Figures 11A, 11B, 11C:
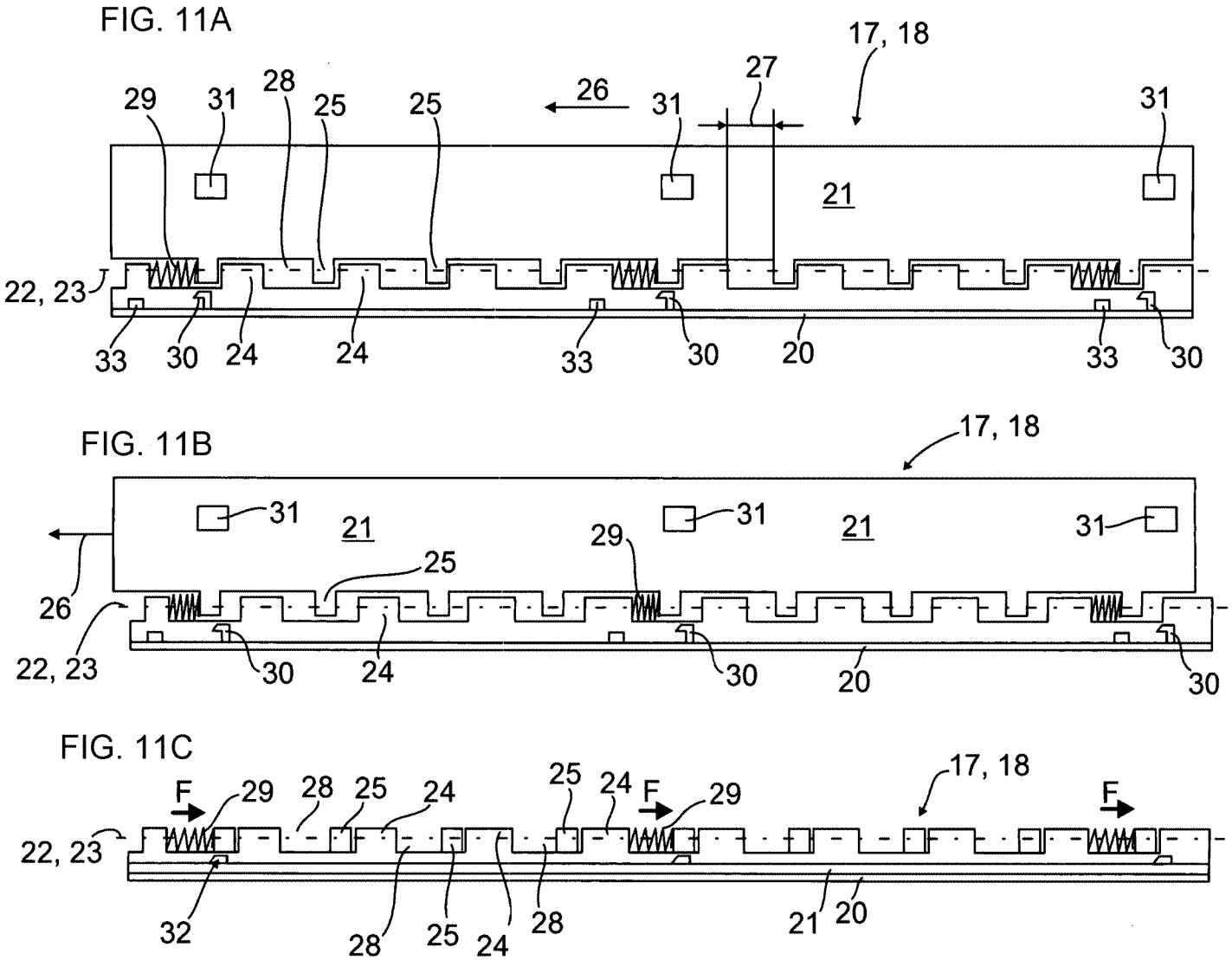
FIG. 11 shows a front view of the hinge bar during the transition from the folded-open position (FIG. 11*a*) into the folded-together, latched position of the hinge limbs (FIG. 11*c*), FIG. 11*b* showing the relative displacement of the second hinge limb relative to the first hinge limb, which relative displacement acts counter to the spring force.

If the punching plate 19 is then hooked by means of the register recesses 34 on the locating pins 33 of the first hinge limb 20, the second hinge limb 21 can be folded or pivoted downward, starting from the open hinge limb position which is shown in FIG. 9 and in FIG. 11*a*, in order to produce the latching engagement between the latching recesses 31 and the latching hooks 30 of the latching connection 32.

Figure 10A:
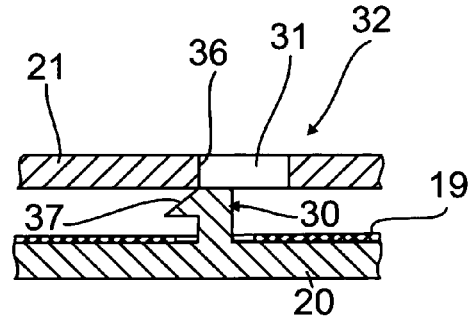
FIG. 10 shows diagrammatic outline illustrations which show the latching according to the invention of the second hinge limb to the first hinge limb in different stages in principle related to the latching hook rear grip.
Figure 10B:
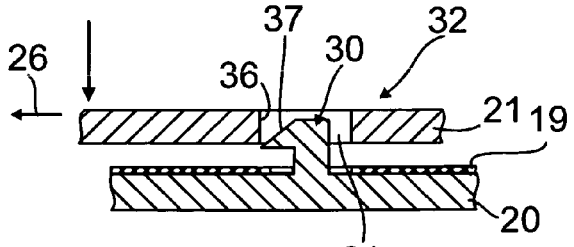

As can be seen, in particular, from the combination of FIGS. 10*a* to 10*d* in conjunction with the combination of FIGS. 11*a* to 11*c*, in the open basic position, the spring elements 29 press the second joint parts of the second hinge limb 21 to a greater or lesser extent into a bearing connection on the associated right-hand first joint part in the plane of the drawing of said figures. If the second hinge limb 21 is then folded down, it passes with an edge region 36 (FIG. 10*a*) into a bearing connection on a ramp-shaped oblique surface region 37 of the latching hook 30. If the second hinge limb 21 is then pressed downward further, as shown in FIG. 10*b*, the edge region 36 of the latching recess 31 slides downward along the ramp-shaped oblique surface region 37, as a result of which the second hinge limb 21 is correspondingly displaced in the direction of the arrow 26 (displacement direction), to be precise counter to the force of the spring elements 29.

Figure 10C:
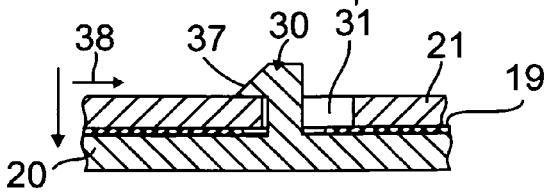
Figure 10D:
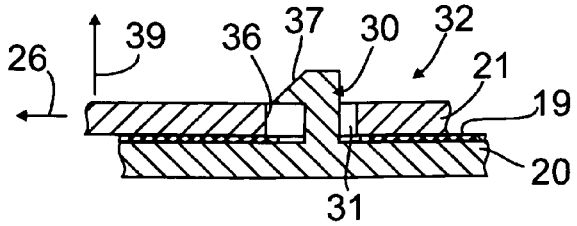

If, in accordance with the diagrammatic illustration of FIG. 10*c*, the second hinge limb 21 is then pressed further downward in the direction of the first hinge limb 20, the edge region 36 of the latching recess 31 passes out of the engagement region of the oblique surface region 37 and, on account of the spring prestress or force loading as a result of the spring elements 29, snaps by way of the edge region 36 under the head region or oblique surface region 37 of the latching hook 30 (arrow 38 in FIG. 10*c*), as a result of which the spring-loaded, prestressed latching connection between the two hinge limbs 20, 21 is then produced.

If this latching connection is to be released again, the second hinge limb 21 is correspondingly displaced in the reverse direction, as viewed in the hinge axis longitudinal direction, once again in the displacement direction 26 counter to the force of the spring elements 29 (FIG. 10*d*), as a result of which the edge region 36 passes out of engagement with the latching hook 30 and the second hinge limb 21 is then subsequently folded upward, the latching hook 30 then dipping with its head region through the latching recess 31. The two hinge limbs 20, 21 are then situated again in the starting position which is shown in FIG. 10*a* and corresponds to that of FIG. 11*a*.

In order for it to be possible in a simple and functionally reliable way to displace the second hinge limb 21 relatively counter to the force of the spring elements 29 with respect to the first hinge limb 20, tool attachments 40 can be provided, for example, on the second hinge limb 21, which tool attachments 40 are configured, for example, as through holes or stamped perforations and in which tool attachments 40, for example, a tool in the manner of a screwdriver can be inserted. This is shown merely by way of example and diagrammatically in FIG. 8.

In order, for example, to make a reliable flat bearing connection of the plate-shaped hinge limbs 20, 21 possible in their folded-together state, corresponding cutouts or recesses 41 are provided on the second hinge limb 21, as can be seen, in particular, from FIGS. 8 and 9, which cutouts or recesses 41 are assigned, for example, to the locating pins 33, the latching hooks 33 and, in a way which is still to be described, the clamping bolts 42 and ensure that the latter do not impede the flat contact of the hinge limbs 20, 21.

Finally, in a side view, FIGS. 4 and 5 once again diagrammatically show the closing and clamping of the punching plate edge region between the two hinge limbs 20, 21.

FIGS. 11*a* to 11*c* once again diagrammatically show the above-described latching in relation to a front view of the hinge bars 17, 18; it is to be expressed here, in particular in conjunction with FIG. 11*b*, that it goes without saying that it is also possible to also already displace the second hinge limb 21 in the folded-up state in the displacement direction 26 counter to the force of the spring elements 29 and subsequently to displace the second hinge limb 21 into the position which is shown in FIG. 11*c* and in which, once again in accordance with the force arrows F, the spring elements 29 press the edge regions 36 of the latching recesses 31 into a positively locking rear grip below the latching hooks 30 or a latching hook region there and also hold said edge regions 36 there.

As can be seen, in particular, from the figures which have just been described, the heads of the latching hooks 30 are oriented in each case in the hinge axis longitudinal direction in the same direction, as a result of which firstly the production of a simple latching engagement is ensured and secondly the release of the latching engagement can also be carried out in a simple and functionally reliable manner.

It goes without saying that all the latching recesses 31, latching hooks 30 and joint parts 24, 25 including displacement travel 27 and/or the free region 28 are of course to be adapted to one another and designed in such a way that, during the latching engagement, all the latching recesses 31 engage behind the latching hooks 30 in substantially the same way.

In order to ensure a relative adjusting option between the hinge bars 17, 18 and the base plate 10, a screw and oversize connection is provided which, as can be seen, in particular, from the combination of the left-hand image half of FIG. 3 and FIG. 6, has a base plate-side threaded recess 44 for a threaded shank 45 of a clamping bolt 42, the threaded recess 44 being assigned a recess 43 of the first hinge limb 20, which recess 43 has a defined oversize with respect to said threaded recess 44 and, in the case of an open clamping bolt 42, permits a relative displacement of the hinge limb recess 43 and therefore of the first hinge limb 20 relative to the threaded recess 44 or relative to the threaded shank 45, received therein, of the clamping bolts, which is shown diagrammatically in FIG. 3 by the different diameter regions $d_2$ of the hinge limb recess 43 and $d_1$ of the threaded recess 44. The size and type of said oversize configuration of the hinge limb recess 43 with respect to the threaded recess 44 and therefore with respect to the threaded shank 45 of the clamping bolts 42 fixes the adjusting options, which is indicated diagrammatically in FIG. 3 by the double arrows 46 and 47. It goes without saying that said two double arrows specify merely a diagrammatic displacement direction and of course a displacement in all spatial directions in the base plate plane is possible in the oversize design which is shown in FIG. 3.

The threaded recess 44 can be formed, for example, by an additional component 49, for example a nut or the like, which bears against the base plate in a bearing connection on the underside of said base plate. As an alternative to this, however, the threaded recess 44 can also be made directly integrally in the base plate 10.

Furthermore, as can be seen from FIG. 6, in the screwed-in state, the clamping bolts 42 clamp the first hinge limb 20 by way of their screw head 48 between them and the base plate 10, with the result that, in the screwed-in and tightened state of the clamping bolts 42, said first hinge limb 20 is held on the base plate 10 in a positionally fixed manner. As can also be seen, in particular, from FIG. 3, the screw head has a diameter $d_3$ which is greater than the associated hinge limb recess 43, with the result that it is ensured in a simple way that a reliable clamping connection can be produced.

Furthermore, as can be seen from the combination of, in particular, the right-hand image half of FIG. 3 and FIG. 6, in the punching plate region which is assigned to the clamping bolts 42, the punching plate 19 has a punching plate recess 51 which has a defined oversize with respect to the screw head 48 of the clamping bolts 42, which punching plate recess 51 firstly makes the access to the screw head 48 of the clamping bolts 42 possible, for example in order to insert a tool into a tool attachment 50 of the clamping bolts 42, for example a screwdriver or the like.

If it is then determined, for example, during a test run of the printing press that the tool lines 52 of the punching plate 19 which are configured, for example, as elevated cutting or punching profiles are not situated in precisely the desired position, a relative adjustment of the hinge bars 17, 18 relative to the base plate can be performed on the impression cylinder and therefore in an inline manner by way of release of the clamping bolts 42 of one or both hinge bars 17, 18, without it being necessary for the punching plate 19 or the base plate 10 to be removed from the printing press for this purpose. As shown in FIGS. 8 and 9, the second hinge limbs 21 also particularly preferably have recesses 41 here which are assigned to the clamping bolts 42 or the hinge limb recesses 43 and ensure that the relative displacement of the hinge bar relative to the base plate 10 can take place even without opening the latching connection 32 of the hinge bars 17, 18.

Furthermore, as can be seen from the right-hand image half of FIG. 3, in addition to register recesses 34, the punching plates 19 also have latching hook recesses 53, furthermore, in the edge region, which latching hook recesses 53 have a defined oversize with respect to the external dimensions of the latching hooks 30.

Furthermore, as can be seen from the combination of FIG. 2 and FIG. 3 (right-hand image half there), the punching plate 19 and possibly also the base plate 10 in each case have an angled-over edge 54 which runs parallel to the cylinder axis on the edge regions which lie opposite one another in the cylinder circumferential direction, which angled-over edge 54 is in each case assigned precisely to the cylinder channel edges 55 of the rubber blanket cylinder 3 which define a printing start and a printing end of the printing surface region. This ensures in a simple way that the punching plate 19 rests on the base plate 10 in a flat bearing connection without a gap in the printing surface region. In addition, the punching plate 19 can be hooked and positioned in a very simple way on the associated hinge bar-side locating pins, since it rests flatly there as a result of the angled-over edge.

In summary, the solution according to the invention therefore results in a considerable reduction in the time expenditure during the clamping process of a punching plate or a base sheet. On account of the arrangement of a hinge bar instead of the conventional fastening bars which are described in the introduction to the description, increased use security results by way of fewer individual components. Furthermore, a hinge bar of this type can also reduce the overall height of the fastening bar further by a few millimeters, for example by approximately from 2.5 to 3 mm, which results in increased use security by way of a greater movement radius of the base plate at the start of printing without damage to the machine or the base plate.

The possible use of punching plates which have register recesses therefore results for the first time in the possibility of register adjustment in the case of punching plates without the use of base sheets.

The invention claimed is:

1. A device for perforating and/or fluting and/or punching for rotary presses and/or rotary printing presses, the device comprising:

a rotary cylinder;

a holding device fastening a base plate of flexible and dimensionally stable material on said rotary cylinder;

a flexible tool plate carrying at least one processing tool, and fastening bars spaced apart in a circumferential direction of said rotary cylinder holding said flexible tool plate on said rotary cylinder, said flexible tool plate being held on said rotary cylinder resting directly or indirectly on said base plate;

each of said fastening bars being formed by a multiple-limb hinge bar having a first hinge limb and a second hinge limb, wherein:

said first hinge limb is mounted to hold said multiple-limb hinge bar on said rotary cylinder; and said second hinge limb is articulated to said first hinge limb via a hinge axis so that, when said first and second hinge limbs are folded onto one another, said first and second hinge limbs receive and clamp said tool plate therebetween.

2. The device according to claim 1, which comprises a latching connection configured for releasably latching said hinge limbs to one another.

3. The device according to claim 2, which comprises at least one force accumulator (e.g., spring element) disposed to pre-stress said hinge limbs into a latching engagement in the folded-together state, and wherein said second hinge limb is displaceable counter to a force of said at least one force accumulator, in order to bring said second hinge limb into and/or out of latching engagement with said first hinge limb.

4. The device according to claim 3, wherein said at least one force accumulator is integrated into a hinged joint connection between said first and second hinge limbs, said hinged joint connection forming said hinge axis (e.g., integrated into at least one hinge axis free region on the hinge axis side which releases a displacement travel in the hinge axis longitudinal direction).

5. The device according to claim 3, which comprises joint parts formed on said hinge limbs, wherein said joint parts are spaced apart from one another and engage at least in regions around a hinge rod forming said hinge axis, wherein said joint parts of said hinge limbs which are connected pivotably to one another are offset with respect to one another in such a way that they in each case engage around different hinge rod part regions and/or in each case one joint part of said first hinge limb follows a joint part of said second hinge limb, in that, in relation to the latched and the folded-together state of said hinge limbs, said joint parts are arranged as viewed in said hinge axis longitudinal direction in such a way that a hinge rod-side free region which defines a displacement travel and is not engaged around by any joint part is formed between said joint parts of said second hinge limb and a joint part of said first hinge limb, which joint part lies in front in the displacement direction of said second hinge limb, and wherein a force accumulator (e.g., spring) is arranged at least in one of said free regions (preferably around the associated hinge rod part region) for prestressing the respectively associated joint part of said second hinge limb in the direction away from that joint part of said first hinge limb which lies in front in the displacement direction, and therefore counter to the displacement direction (i.e., pre-stress in the direction of that joint part of the first hinge limb which lies behind).

6. The device according to claims 3, wherein said latching connection comprises at least one latching hook which protrudes from said first hinge limb and, in the latched state, is engaged behind with a positive lock by an edge region of a latching recess of said second hinge limb.

7. The device according to claim 6, wherein said at least one latching hook or at least one latching hook has a ramp-shaped oblique surface region which is assigned to the edge region of said latching recess and along which the edge region of said latching recess, during its transfer into the latching engagement, is slidingly guided such that at the same time said second hinge limb is displaced relative to said first hinge limb in the hinge axis longitudinal direction counter to the force of said at least one force accumulator, the edge region of said latching recess snapping under the associated latching hook and engaging behind the latter (preferably with positive lock) at the end of the ramp-shaped oblique surface region with a loading by a force of said at least one force accumulator.

8. The device according to claim 6, wherein, as viewed in the hinge axis longitudinal direction, a plurality of latching hooks which are spaced apart from one another are arranged on the first hinge limb, and/or in that, as viewed in the hinge axis longitudinal direction, the at least one latching hook is oriented in such a way that the latching hook-side rear grip region, into which the edge region of the latching recess engages, lies in the hinge axis longitudinal direction.

9. The device according to claim 1, wherein, in the folded-together state of the hinge limbs, said hinge limbs bear against one another substantially in a flat bearing connection even without a tool plate and/or bear against the tool plate in a flat bearing connection with clamping of said tool plate, it preferably being provided that the second hinge limb has a cutout and/or a recess in the region of elements and/or components which protrude from the first hinge limb.

10. The device according to claim 1, wherein said tool plate is held releasably held on said rotary cylinder and/or displaceably within predefined setting ranges relative to said rotary cylinder and wherein said tool plate can be fixed positionally after a displacement thereof.

11. The device according to claim 10, wherein said tool plate is held releasably held on one of said holding device, said base plate, or said at least one said hinge bar and said tool place is fixable in position relative to said one of said holding device, said base plate, or said at least one hinge bar after displacement.

12. The device according to claim 10, wherein at least one of the following is true:

a) at least one said hinge bar is displaceable relative to said rotary cylinder, or relative to said holding device, or relative to said base plate, and said tool plate is connected to the respectively associated hinge bar in a positionally fixed and non-displaceable position;

b) said tool plate is displaceable relative to at least one of said hinge bars, and said hinge bars are connected fixedly and non-displaceable to said rotary cylinder, or said holding device and/or to said base plate;

c) both said hinge bars are displaceable relative to said rotary cylinder, or relative to said holding device and/or relative to said base plate, and said tool plate is displaceable relative to at least one of said hinge bars.

13. The device according to claim 10, wherein said first hinge limb is fixed by way of at least one clamping and oversize connection on said base plate and/or on the holding device for an arrangement of said tool plate on said holding device and/or on said base plate such that it can be displaced in predefined setting ranges and can subsequently be fixed again, which clamping and oversize connection has a holding device-side or base plate-side threaded recess for a threaded shank of a clamping bolt, preferably a clamping screw or a tensioning bolt, and which threaded recess is assigned a recess of the first hinge limb, which recess has a defined oversize with respect to said threaded recess and, in the case of an open clamping bolt, permits a relative displacement of the hinge limb recess relative to the threaded recess and/or relative to the threaded shank, received therein, of the clamping bolt, a head part of the clamping bolt, which head part has an oversize with respect to the hinge limb recess, clamping said first hinge limb fixedly and therefore positionally fixing same when said clamping bolt is tightened.

14. The device according to claim 13, which comprises a plurality of locating pins spaced apart from one another in the hinge axis longitudinal direction and disposed on said first hinge limb, on which locating pins said tool plate can be hooked in a releasable and/or positively locking manner by way of associated register recesses.

15. The device according to claim 14, wherein said locating pins have an end region which widens in a spherical head and onto which the tool plate is buttoned with said register recesses engaging behind said spherical head end region.

16. The device according to claims 14, wherein, on edge regions lying opposite one another in the cylinder circumferential direction, said tool plate is formed with register recesses which have an oversize with respect to the locating pins of the hinge bar which are assigned to the register recesses (in particular the locating pins of the first hinge limb which are assigned to the register recesses), in such a way that, in the case of an open hinge bar, the tool plate can be displaced within predefined setting ranges relative to the hinge bar and therefore relative to said rotary cylinder (in particular relative to the base plate and/or relative to the holding device), and is clamped again in a positionally fixed manner between said hinge limbs after a displacement.

17. The device according to claim 16, wherein said hinge bar is held fixedly and non-displaceable on said rotary cylinder (in particular on the holding device and/or on the base plate).

18. The device according to claim 1, wherein said tool plate comprises a base sheet (e.g., plastic) on which elevated processing profiles can be applied (e.g., adhesively bonded), said base sheet having register recesses formed in edge regions thereof opposite one another in the circumferential direction of said rotary cylinder and configured for cooperation with hinge bar-side locating pins.

19. The device according to claim 1, wherein said tool plate is a punching plate which, on edge regions lying opposite one another in the circumferential direction of said rotary cylinder, is formed with register recesses configured for cooperation with hinge bar-side locating pins.

20. The device according to claim 1, wherein said first hinge limb is mounted to hold said multiple-limb hinge bar on said holding device.

21. The device according to claim 1, wherein said first hinge limb is mounted to hold said multiple-limb hinge bar on said base plate.

* * * * *